United States Patent [19]

Postman et al.

[11] 4,111,818

[45] Sep. 5, 1978

[54] PROCESSABILITY OF MELT SPUN YARNS

[75] Inventors: William Postman; James B. Louch; Hermann Buchert, all of Anderson, S.C.

[73] Assignee: Dow Badische Company, Williamsburg, Va.

[21] Appl. No.: 824,470

[22] Filed: Aug. 15, 1977

Related U.S. Application Data

[63] Continuation-in-part of Ser. No. 680,945, Apr. 28, 1976, abandoned.

[51] Int. Cl.[2] ..... D06M 13/18

[52] U.S. Cl. ..... 252/8.9; 8/115.6; 252/8.6; 428/395

[58] Field of Search ..... 252/8.9, 8.6; 8/115.6; 428/395

[56] References Cited

U.S. PATENT DOCUMENTS

| | | | |
|---|---|---|---|
| 2,677,700 | 5/1954 | Jackson et al. | 252/8.9 |
| 2,803,565 | 8/1957 | Sagar | 428/395 |
| 2,980,556 | 4/1961 | McClelland | 428/394 |
| 3,113,369 | 12/1963 | Barrett | 428/395 |
| 3,446,734 | 5/1969 | Coats | 428/395 |
| 3,592,684 | 7/1971 | Smith | 428/395 |
| 3,639,154 | 2/1972 | Sawa et al. | 428/395 |

*Primary Examiner*—William E. Schulz
*Attorney, Agent, or Firm*—George F. Helfrich

[57] ABSTRACT

Melt spun yarns are treated with a finish which is an aqueous solution or dispersion containing an alkoxylated alcohol or thiol as the sole essential organic component thereof.

8 Claims, No Drawings

PROCESSABILITY OF MELT SPUN YARNS

CROSS REFERENCE

This application is a continuation-in-part of our copending application Ser. No. 680,945, filed Apr. 28, 1976 and now abandoned.

BACKGROUND OF THE INVENTION

1. Field of the Invention

This invention relates generally to the lubricating and conditioning of textile fibers, filaments, and yarns. It relates particularly to an aqueous solution or dispersion for melt spun yarns comprising a single synthetic organic component which is heat stable, light stable, chemically stable, and bio-degradable.

2. Prior Art

Finishes are universally applied to fiber surfaces to improve the subsequent handling and processing of the fibers. The composition and amount of finish applied depend in large measure upon the nature — i.e., chemical composition — of the fiber, the particular stage in the processsing of the fiber, and the end use in view.

For example, spin finishes are applied to melt-spun filaments to lubricate them before the winding thereof as yarns on a spin bobbin, and to prevent balooning apart of the individual filaments because of the electrostatic charges which accumulate on their surfaces in the spinning processes. Such spin finishes also provide a slight cohesion between the individual filaments of a yarn thereby aiding in the prevention of damage during the winding and unwinding of the yarn.

The application of spin finish is generally accomplished by contacting the solidified filaments with a solution, or more commonly, an organic-water emulsion, containing at least a lubricant and an antistatic agent. Wetting agents, as well as emulsifiers and viscosity stabilizers, are also commonly found in spin finish emulsions. Ordinarily, a wick, or a roller rotating in a bath of the finish, is employed to apply the finish to the filament surfaces.

Except for equilibrium amounts, all water is subsequently removed from the surface of the treated yarn — for example, as a result of the heat generated in drawing and other yarn processing operations, or by evaporation in storage.

Acceptable spin finishes must fulfill a number of requirements in addition to providing the desired lubricating and antistatic effects. For example, they should be easy to apply (and to remove if desired), they should have good light stability, thermal stability, and chemical stability, and they should not adversely affect the physical or chemical properties of the filaments to which they are applied or subsequent processes to which the treated filaments are subjected.

Of the many compositions which have been proposed as finishes, especially spin finishes for melt spun filament yarns, some of the more noteworthy are found in the following U.S. Pat. Nos. 3,649,535; 3,428,560; 2,803,565; 3,306,850; 3,850,819; 3,652,419; 3,781,202; 3,056,744; 2,853,453; 2,842,462; 3,814,627; 3,446,734; 3,113,369; 3,639,154; and 2,677,700. Notwithstanding the efficacy of these and similar compositions, all consist of a plurality of essential organic components in addition to water, and as a result, many require the presence of an emulsifier or emulsification system as well. Moreover, in certain applications, as exemplified by the standard space dyeing procedures for polyamide yarns, spin finishes are not removed from the yarns to which they were applied. That is to say, after being stored for varying lengths of time, polyamide yarns to be space dyed are subjected to various treatments which, because of the action of heat and/or light and/or chemicals, unfortunately result in an undesirable yellowing of virtually all of the spin finishes heretofore employed. Ordinarily such yellowing in turn adversely affects both shade and clarity of the space dyed product. Furthermore, in applications wherein spin finishes must be removed (e.g., by scouring with water either before or after certain yarn processing steps), ecological problems are generally inherent in the final disposal of effluents.

SUMMARY OF THE INVENTION

As a consequence, it is the primary object of the present invention to provide a novel finish composition for treating melt spun yarns which (1) does not require the presence of more than one essential synthetic organic component; (2) exhibits outstanding heat stability, light stability and chemical stability; and (3) is biodegradable. A related object is the provision of melt spun yarns which are very efficiently handled and readily processed from filaments produced under all conditions commonly employed in the art. As is comprehended by those of skill in this art, "component" as used in the instant specification and claims is to be understood as one or more members of a distinct, well-recognized class of compounds.

The objects set forth above are achieved, and the disadvantages of the prior art are obviated by the provision of:

I.

A process which comprises treating melt spun filaments with an aqueous solution or dispersion containing about 10 to 30 percent by weight of a compound selected from the group consisting of: (a) a water-soluble or dispersible condensation product of one mole of a compound having the general formula R—X—H, wherein R is a saturated or unsaturated aliphatic group having from 6 to 18 carbons, and X is oxygen or sulfur; with from 7 to 12 moles of ethylene oxide; and (b) a water-soluble or dispersible condensation product of one mole of a compound having the general formula R—X—H, wherein R is a saturated or unsaturated aliphatic group having from 6 to 18 carbons, and X is oxygen or sulfur; with from 5 to 20 moles of ethylene oxide and from 2 to 20 moles of propylene oxide.

Results are very highly beneficial when the filaments are composed of a synthetic polymeric material selected from the group consisting of polyamides (especially polycaprolactam) and polyesters (especially polyethylene terephthalate). Moreover, in such instances especially advantageous results are achieved if the compound R—X—H is a monohydric alcohol or a thiol having from 12 to 15 carbon atoms in the molecule.

The objects of the invention are achieved, and the disadvantages of the prior art are in like manner obviated by the provision of:

II.

Melt spun filament yarns having incorporated thereon from about 0.1 to about 3 percent by weight of an organic portion of an aqueous spin finish composition, which organic portion is a compound selected from the group consisting of: (a) a condensation product of one mole of a compound having the general formula R—X—H, wherein R is a saturated or unsaturated aliphatic group having from 6 to 18 carbons and X is oxygen or sulfur; with from 7 to 12 moles of ethylene oxide; and (b) a condensation product of one mole of a compound having the general formula R—X—H, wherein R is a saturated or unsaturated aliphatic group having from 6 to 18 carbons and X is oxygen or sulfur; with from 5 to 20 moles of ethylene oxide and from 2 to 20 moles of propylene oxide.

These yarns are especially efficiently handled and most readily processed when the individual filaments are composed of a synthetic polymeric material selected from the group consisting of polyamides (especially polycaprolactam) and polyesters (especially polyethylene terephthalate), and the compound R—X—H is a monohydric alcohol or thiol having from 12 to 15 carbon atoms in the molecule. In this regard, when the filaments are composed of polycaprolactam, especially advantageous results are obtained when about 1 to about 3 percent of the organic portion of the aqueous spin finish is incorporated thereon. Similarly, when the filaments are composed of polyethylene terephthalate, especially advantageous results are obtained when about 0.2 to about 2 percent by weight of the organic portion of the aqueous spin finish composition is incorporated thereon.

The prior art does not comprehend, teach, or intimate that the alkoxylated alcohols and thiols specified in detail hereinabove may be employed as the sole essential organic component of a finish composition which affords ease of application and removal and provides heat (oxidative) stability and chemical stability, as well as the desired frictional, cohesive, and antistatic properties for polyamide and polyester yarns. That is to say, nowhere in any reference is there even the remotest suggestion that a particularly defined alkoxylated alcohol or thiol may provide all of the properties desired in a textile fiber finish composition especially suitable for polyamides and polyesters.

DETAILED DESCRIPTION OF THE PREFERRED EMBODIMENTS

For a more complete understanding of the present invention, reference should be made to the description of the preferred embodiments thereof, which is set forth in detail below.

The process of the present invention has shown outstanding utility when the filaments treated are melt spun from a synthetic material selected from the group consisting of polyamides and polyesters. Polycaprolactam and polyethylene terephthalate are employed with especial advantage. The finish is most beneficially applied to the filaments after their solidifications in the melt spinning state, and prior to their combination into a multifilament yarn. However, the finish may be applied with beneficial results to other constructions, especially spun yarns, which comprise combined staple fibers. The finish is an aqueous solution or dispersion containing as the sole essential organic component thereof a compound which is described below. Although one such compound is completely sufficient, more than one — in fact a mixture of many — of the below-described compounds may be utilized, if desired or required for any reason. Even if many such compounds are employed, a single component is still comprehended, as all of the compounds having utility fall within the following class: alkoxylated compounds having the general formula R—X—H, wherein X is oxygen or sulfur-viz: alkoxylated alcohols and thiols. The aqueous solution or dispersion contains a total of about 10 to about 30 percent by weight of one or a mixture of the below-described synthetic organic compounds. When less than about 10 percent by weight of such compound(s) is (are) present in the aqueous solution of dispersion, desirable lubricating and antistatic effects are not readily and conveniently provided. Moreover, attempts at the utilization of a solution or dispersion containing a total of more than about 30 percent by weight of such compounds, result in solution or dispersion instability, and/or difficulty in the uniform application of the solution or dispersion to the fiber surfaces.

The aqueous solution or dispersion contains one or more compounds selected from the group consisting of:

A. A water-soluble or dispersible condensation product of one mole of a compound having the general formula R—X—H with from 7 to 12 moles of ethylene oxide. In the general formula R—X—H, R is saturated or unsaturated aliphatic group having from 6 to 18 carbons; the backbone of which is either straight-chain or branched. From 12 to 15 carbon atoms in the group are especially preferred. In the general formula R—X—H, moreover, X is either oxygen or sulfur — i.e., comprehended is an ethoxylated aliphatic monohydric alcohol or thiol. Such compounds are prepared according to standard techniques or synthetic organic chemistry by reacting the chosen alcohol or thiol with the oxirane in the desired proportion, and such are also readily available commercially.

B. A water-soluble or dispersible condensation product of one mole of a compound having the general formula R—X—H with from 5 to 20 moles of ethylene oxide and from 2 to 20 moles of propylene oxide. In the general formula R—X—H, R is a saturated or unsaturated aliphatic group having from 6 to 18 carbons, the backbone of which is either straight chain or branched. From 12 to 15 carbon atoms in the group are especially preferred.

Moreover, in the general formula R—X—H, X is either oxygen or sulfur — i.e., comprehended is an aliphatic monohydric alcohol and thiol which has been ethoxylated and propoxylated. It is to be observed in this regard that either random copolymeric configurations or block copolymeric configurations have utility. These compounds are prepared according to standard techniques of synthetic organic chemistry by reacting the chosen alcohol or thiol with the oxirane and methyloxirane respectively in the desired proportions, and such are also readily available commercially.

The single essential synthetic organic component of itself provides the excellent frictional, antistatic, and cohesive properties which are essential if melt spun yarns are to be successfully processed according to standard procedures commonly employed in the art.

The chosen synthetic organic compound or mixture is added in the appropriate amount to water at a temperature below 35° C with agitation thereof to prepare the aqueous solution or dispersion, which is then applied to the surfaces of the melt spun fibers in any convenient manner, such as, for example, by contact with a roller rotating in a trough containing the aqueous solution or dispersion. Other methods such as spraying, or application by means of a wick are also acceptable. The solution or dispersion is so applied to continuous filaments are staple fibers, the surfaces of which may be smooth or rough, to provide an organic component on yarn content of between about 0.1 and about 3 percent by weight. The very best results are achieved when the organic component is incorporated on polycaprolactam filaments in an amount sufficient to provide from about 1 to about 3 percent by weight. Similar optimum results are obtained when the organic component is incorporated on polyethylene terephthalate filaments in an amount sufficient to provide from about 0.2 to about 2 percent by weight. By way of example, a 15 percent aqueous solution may be applied to polycaprolactam continuous filament yarn being spun at about 500 meters/minute by means of contact with a roller rotating at a speed of about 5 r p m in a trough containing the solution, to provide an organic component on yarn content (as found by actual analysis) of about 1 percent.

Produced is a melt spun yarn (e.g. of polyamide — especially polycaprolactam — or of polyester — especially polyethylene terephthalate) which has excellent filament-to-filament cohesion (as determined by visual examination) and which, when wound, effects an evenly-formed, compact firm package (as determined by visual examination). The draw-texturing performance of such polyamide yarns (as determined by measuring the number of filaments broken in the draw zone in a standard draw-texturing process per unit of time) is at least the equal of that obtained when commercially-available prior art finishes are incorporated in the recommended amounts on otherwise identical yarns. Moreover, the resistance to yellowing of such polyamide yarns according to the present invention (e.g., polycaprolactam yarns) when exposed to dry heat, light, ozone, oxides of nitrogen, and/or steam is superior to that of otherwise identical yarns having finishes of the prior art incorporated thereon. Finally, under conditions wherein the finish is removed (e.g., by scouring) prior to dyeing of the yarn (e.g., as is ordinarily the case with polyethylene terephthalate yarns according to the present invention), an ecological problem in effluent disposal is not presented, as the finishes employed in the practice of the present invention are readily bio-degradable.

The present invention, as well as its objects an advantages, may be better understood by referring to the following detailed examples, which are set forth for illustrative purposes only.

EXAMPLE I

In each of a series of individual runs, a spin package was produced from either 7700/136 polycaprolactam yarn or 560/35 polyethylene terephthalate yarn, as set forth in Table I below, at conjoint spinning speeds of approximately 500 meters/minute and 1200 meters/minute, respectively. In each run a separate finish composition was applied as an aqueous solution or dispersion by means of a standard applicator roll to the solidified filaments at a given point between the spinnerette and the take-up bobbin. Each individual finish composition was prepared by adding the synthetic organic compound(s) as listed in Table I below with moderate agitation to water maintained at a temperature below 35° C to provide an aqueous solution or dispersion of the stated concentration. The solution or dispersion so produced was placed in a finish trough, through which the applicator roll was allowed to rotate. For each run, spin package formation and filament-to-filament cohesion were determined by visual examination and the organic component-on-yarn content was determined by chemical analysis. The results of all of these determinations are summarized in Table I.

TABLE I

| | | | Organic Component of Finish | | | | | |
|---|---|---|---|---|---|---|---|---|
| Run No. | | Yarn | | Nature | Concentration % Weight | Organic Component-On-Yarn Content, % Weight | Spin Package Formation | Filament-to-Filament Cohesion |
| 1 | (This Invention) | PC[1] | (See Exp.) 3 | (See Exp.) | 15 | 1 | Very Good | Very Good |
| 2 | " | PC[1] | " 4 | " | 15 | 1 | " | " |
| 3 | " | PET[2] | " 4 | " | 20 | 0.9 | " | " |
| 4 | " | PC[1] | " 5 | " | 15 | 1 | " | " |
| 5 | " | PET[2] | " 5 | " | 20 | 0.6 | " | " |
| 6 | " | PC[1] | " 6 | " | 15 | 1 | " | " |
| 7 | " | PET[2] | " 6 | " | 20 | 0.6 | " | " |
| 8 | " | PC[1] | " 7 | " | 15 | 1 | " | " |
| 9 | " | PC[1] | " 8 | " | 15 | 1 | " | " |
| 10 | " | PET[2] | " 8 | " | 20 | 0.65 | " | " |
| 11 | " | PC[1] | " 9 | " | 22 | 1.2 | " | " |
| 12 | " | PET[2] | " 9 | " | 20 | 0.4 | " | " |
| 13 | " | PC[1] | " 10 | " | 22 | 1.2 | " | " |
| 14 | " | PET[2] | " 10 | " | 20 | 0.5 | " | " |
| 15 | " | PC[1] | " 11 | " | 22 | 1.2 | " | " |
| 16 | " | PC[1] | " 12 | " | 30 | 2 | " | " |
| 17 | " | PC[1] | " 13 | " | 30 | 2 | " | " |
| 18 | " | PC[1] | " 14 | " | 30 | 2 | " | " |
| 19 | " | PC[1] | " 15 | " | 30 | 2 | " | " |
| 20 | " | PC[1] | " 16 | " | 25 | 1.5 | " | " |

TABLE I, EXPLANATION

1 — 7700/136 polycaprolactam yarn
2 — 560/35 polyethylene terephthalate yarn
3 — C-14 saturated aliphatic straight chain monohydric alcohol ethoxylated with 7 moles of ethylene oxide
4 — C-14 saturated aliphatic straight chain monohydric alcohol ethoxylated with 8 moles of ethylene oxide
5 — Mixture of saturated aliphatic straight chain monohydric alcohols having 14, 16, and 18 carbons, which mixture was ethoxylated with 9 moles of ethylene oxide
6 — Mixture of saturated aliphatic straight chain monohydric alcohols having 12–15 carbons, which mixture was ethoxylated with 12 moles of ethylene oxide
7 — Mixture of saturated aliphatic straight chain monohydric alcohol having 12–15 carbons, which mixture was ethoxylated with 5 moles of ethylene oxide and propoxylated with 16 moles of propylene oxide — random copolymeric structures
8 — Mixture of saturated aliphatic straight chain monohydric alcohols having 12–15 carbons, which mixture was ethoxylated with 8 moles of ethylene oxide and propoxylated with 4 moles of propylene oxide — random copolymeric structures 9 — Mixture of saturated aliphatic straight chain monohydric alcohols having 12–15 carbons, which mixture was ethoxylated with 16 moles of ethylene oxide and propoxylated with 8 moles of propylene oxide — random copolymeric stuctures 10 — Mixture of saturated aliphatic straight chain monohydric alcohols having 12–15 carbons, which mixture was ethoxylated with 11 moles of ethylene oxide and propoxylated with 12 moles of propylene oxide — random copolymeric structures 11 — Mixture of saturated aliphatic straight chain monohydric alcohols having 12–15 carbons, which mixture was ethoxylated with 11 moles of ethylene oxide and propoxylated with 12 moles of propylene oxide — block copolymeric structures 12 — $C_{12-15}$ mixture of saturated aliphatic straight chain monohydric alcohols ethoxylated with 10 moles of ethylene oxide and propoxylated with 2 moles of propylene oxide — block copolymeric structures 13 — $C_{12-15}$ mixture of saturated aliphatic straight chain monohydric alcohols ethoxylated with 20 moles of ethylene oxide and propoxylated with 4 moles of propylene oxide — random copolymeric structures 14 — $C_{12-15}$ mixture of saturated aliphatic straight chain monohydric alcohols ethoxylated with 7 moles of ethylene oxide and propoxylated with 13 moles of propylene oxide — random copolymeric structures 15 — $C_{12-15}$ mixture of saturated aliphatic straight chain monohydric alcohols ethoxylated with 7 moles of ethylene oxide and propoxylated with 13 moles of propylene oxide — block copolymeric structures 16 — $C_{12}$, $C_{14}$, $C_{16}$ mixture of saturated aliphatic straight-chain mercaptans ethoxylated with 7 moles of ethylene oxide and propoxylated with 13 moles of propylene oxide — random copolymeric structures.

EXAMPLE 2

Yarns produced from Runs No. 4, 18 and 20 of Example 1 above were individually knitted into separate hoselegs, which were then cut into 4 × 6 inch double thickness pieces. Each hoseleg was sewn together with a double row of stitches before cutting, in order to prevent the cut edges from raveling and curling. These cut hoselegs are designated as samples 1, 2, and 3, respectively, and are so identified in Table II below. Samples 4, 5, and 6 were prepared by identical procedures from commercially-available competitive greige polyamide yarns (a), (b), and (c), all of which had been treated with multicomponent spin finishes of the prior art. The above samples were then subjected to individual pre-treatments as described below:

A. None

B. Ozone — 20 parts per hundred million of ozone at 40° F and 85% relative humidity at 40° C.

C. Oxides of Nitrogen — 20 hours at ambient conditions with 5 parts per million $NO_x$ chemically generated from sodium nitrite and phosphoric acid.

D. Light — 17 hours in a Xenon Weather-Ometer at 30% relative humidity and 60° C.

E. Heat (1) — 20 hours in a forced air oven at 60° C.
Heat (2) — 1 hour in a forced air oven at 120° C.
Heat (3) — 1 hour in a forced air oven at 140° C.

The samples were then placed in an autoclave and the following procedure was followed:

1. Flush the sealed unit with steam three times, venting after each flush.
2. Steam at 230° F for 5 minutes, then exhaust to 1 psi.
3. Repeat step 2.
4. Raise temperature to 260° F, steam for 5 minutes, exhaust to 4 psi.
5. Repeat step 4 three more times.
6. Steam at 260° F for 8 minutes, exhaust to 1 psi.
7. Let cool for 30 minutes, release pressure and remove samples.

Color change in each of the samples resulting from each of the above pre-treatments, followed by autoclaving, was then determined in McAdam units with the aid of a Dyano Hardy Spectrophotometer and Automated System by comparison with the individual untreated samples. The results of these determinations, which are summarized in Table II below, reveal that the resistance to yellowing of polyamide yarns treated according to the present invention is superior to that of polyamide yarns treated with the multicomponent spin finishes of the prior art. Furthermore, a polyamide yarn treated according to the present invention was submitted for space-dyeing at an independent commercial space dyer. After steaming and autoclaving, this yarn was whiter than any polyamide yarn previously processed. Moreover, this yarn was dyed without difficulty to a critical, light yellow shade — the first time that such had been accomplished with a polyamide yarn.

TABLE II

COLOR CHANGE IN MC ADAM UNITS AFTER PRETREATMENT AND AUTOCLAVING

| | PRETREATMENT | | | | | | |
|---|---|---|---|---|---|---|---|
| Sample No. | None | Ozone | Oxides of Nitrogen | Light | Heat(1) | Heat(2) | Heat(3) |
| 1 (This Invention) | 4.5 | 4.3 | 7.7 | 7.9 | 4.6 | — | — |
| 2 (This Invention) | 2.5 | 6.6 | 8.9 | 5.3 | 4.3 | — | — |
| 3 (This Invention) | 3.2 | 4.7 | 7.0 | 5.2 | — | 6.1 | 11.1 |
| 4 (For Comparison) | 7.9 | 13.1 | 15.8 | 11.7 | 8.4 | 13.0 | 16.1 |
| 5 (For Comparison) | 6.6 | 12.9 | 14.8 | 8.0 | 7.4 | 11.7 | 15.7 |
| 6 (For Comparison) | 5.9 | 9.2 | 12.8 | 11.9 | 7.7 | — | — |

Although the present invention has been described in detail with respect to certain preferred embodiments thereof, it is apparent to those of skill in this art that variations and modifications in this detail may be effected without any departure from the spirit and scope of the present invention, as defined in the hereto-appended claims.

What is claimed is:

1. A process for improving the processability of melt spun yarns of a polymer selected from the group consisting of polyamides and polyesters, which process comprises treating the filaments with an aqeous solution of dispersion containing as the sole essential organic component thereof about 10 to 30 percent by weight of a compound selected from the group consisting of: (a) a water soluble or dispersible condensation product of one mole of a compound having the general formula R—X—H, wherein R is a saturated or unsaturated aliphatic group having from 6 to 18 carbons, and X is oxygen or sulfur; with 7 to 12 moles of ethylene oxide; and (b) a water soluble or dispersible condensation product of one mole of a compound having the general formula R—X—H, wherein R is a saturated or unsaturated aliphatic group having from 6 to 18 carbons, and X is oxygen or sulfur; with from 5 to 20 moles of ethylene oxide and from 2 to 20 moles of propylene oxide.

2. The process of claim 1, wherein the compound R—X—H is a monohydric alcohol having from 12 to 15 carbon atoms in the molecule.

3. The process of claim 2, wherein the filaments are composed of polycaprolactam.

4. The process of claim 2, wherein the filaments are composed of polyethylene terephthalate.

5. Melt spun yarn of a polymer selected from the group consisting of polyamides and polyesters having incorporated thereon fron about 0.1 to about 3 percent by weight of an organic portion of an aqueous spin finish composition, which organic portion contains as the sole essential component thereof a compound selected from the group consisting of: (a) a condensation product of one mole of a compound having the general formula R—X—H, wherein R is a saturated or unsaturated aliphatic group having from 6 to 18 carbons and X is oxygen or sulfur; with from 7 to 12 moles of ethylene oxide; and (b) a condensation product of one mole of a compound having the general formula R—X—H, wherein R is a saturated or unsaturated aliphatic group having from 6 to 18 carbons and X is oxygen or sulfur; with 5 to 20 moles of ethylene oxide and from 2 to 20 moles of propylene oxide.

6. The treated yarn of claim 5, wherein the compound R—X—H is a monohydric alcohol having from 11 to 15 carbon atoms in the molecule.

7. The treated yarn of claim 6, wherein the filaments are composed of polycaprolactam, and from about 1 to about 3 percent by weight of the organic portion of the aqueous spin finish composition is incorporated thereon.

8. The treated yarn of claim 6, wherein the filaments are composed of polyethylene terephthalate, and from about 0.2 to about 2 percent by weight of the organic portion of the aqueous spin finish composition is incorporated thereon.

* * * * *